United States Patent [19]

Weatherby et al.

[11] Patent Number: 4,589,163

[45] Date of Patent: May 20, 1986

[54] SELF CLOSING LIFT RING

[75] Inventors: Robert G. Weatherby, Longboat Key; W. Fred Stein, Sarasota, both of Fla.

[73] Assignee: James A. Huebner, Sarasota, Fla. ; a part interest

[21] Appl. No.: 584,159

[22] Filed: Feb. 27, 1984

[51] Int. Cl.[4] ..... B65D 25/32

[52] U.S. Cl. ..... 16/124; 16/125; 16/127

[58] Field of Search ..... 16/125–127, 16/124; 190/39, 115–118; 220/94 R; D8/356, DIG. 1; 312/330 R, 290, 244; 410/109, 111, 112–114, 106, 107, 108

[56] References Cited

U.S. PATENT DOCUMENTS

| | | | |
|---|---|---|---|
| 398,978 | 3/1889 | Scheer et al. . | |
| 807,170 | 12/1905 | Holtzhouser . | |
| 815,983 | 3/1906 | Sherman | 16/126 |
| 1,110,194 | 9/1914 | Edey | 16/127 |
| 1,803,337 | 5/1931 | Lundquist | 16/126 |
| 2,697,244 | 12/1954 | Lincke | 16/126 |
| 4,098,101 | 7/1978 | Svoboda | 70/134 |
| 4,189,804 | 2/1980 | Flowerday | 16/126 |

*Primary Examiner*—Donald R. Schran
*Assistant Examiner*—James Wolfe
*Attorney, Agent, or Firm*—Julian C. Renfro

[57] ABSTRACT

A lift ring device arranged to normally remain in a flush condition, and involving a generally U-shaped lift loop pivotally mounted upon a base plate, such as a base plate mounted on the hatch lid of a boat. The lift loop is equipped with a pair of arm portions of substantially equal length, with each arm portion terminating in a pintle bent out of the plane of the lift loop. The base plate has a central recess defined over a substantial portion of its circumference by angled sidewalls, and in such recess the lift loop normally resides. A pair of symmetrically placed pintle-receiving holes are located in the sidewalls, which holes are elongate in a direction essentially perpendicular to the plane of the central recess. The interaction of the pintles of the lift loop with their respective holes is such as to prohibit the lift loop from residing in a perpendicular direction with respect to the base plate, thus assuring that the lift ring device will not represent a trip hazard.

21 Claims, 8 Drawing Figures

SELF CLOSING LIFT RING

BACKGROUND OF THE INVENTION

For literally generations it has been known in the art to provide devices variously known as lift rings, drawer pulls, and the like, involving a base member in which is mounted a movable, generally U-shaped lift ring or bail. The base member is typically affixed to the hatch, drawer, or the like by the use of several screws, and a recessed portion is typically provided in the upper or front face of the base member in which the bail may reside when not in use.

When it is desired to lift the hatch or open the drawer as the case may be, the user grasps approximately the middle portion of the bail, pulls it approximately 90° away from the base member, and then proceeds to open the hatch lid or drawer. Since the bail on a drawer is usually in an approximately vertical position, when the bail is released, it normally returns by gravity to a flush position in the recessed portion of the base member.

However, the compartments in boats are usually covered by hatch lids situated in a generally horizontal position. Where the base member of a lift ring is mounted on a generally horizontal surface, gravity can only be depended upon to return the bail to a flush position in the recessed portion of the base member if the bail, when released, does not reside in a vertical, or "dead center" position, or worse, in a position past dead center. In latter case, the force of gravity resists the motion of the bail to return to its flush position in the recessed position of the base member.

Failure of the ball to return to its recess constitutes a safety hazard to a boater's footing; provides an undesirable potential snag for equipment and the person of the boater; and invites damage or destruction of the lift ring resulting from being stepped upon.

In the construction of boats it is particularly desirable to avoid the use of fixed members on the deck of the boat, over which the a boater may trip, these members including cleats, lift rings, and other upstanding devices. Many boats are equipped with hatch lids that are essentially flush, but in the past, these hatch lids were equipped with lift rings that often tended to reside in the vertical position when not in use, thus providing the hazards described above.

It was to overcome disadvantages of this type in the prior art lift rings that the present invention was created. The present invention also eliminates other problems inherent in prior art devices used for lifting hatch lid doors, opening cabinet doors and drawers, and locking of same for security purposes.

In addition to being subject to the problems described above, prior art devices for lifting, opening and/or locking were often difficult to mount and burdensome to maintain.

One particular prior art device used to lift and/or lock hatch lids was claimed by its manufacturer to be flush. In reality it was only flush when in the locked position, and when unlocked, the lifting handle was positioned substantially above the hatch lid, posing all the hazards of a non-flush device. In order to return the device to a flush position, it was necessary to turn and depress it, causing the locking mechanism to actuate. Thus, access to the contents of the hatch was denied until the key was located, inserted, and the device unlocked, returning it again to the non-flush position. In practice, many boaters, for convenience of gaining ready access to the hatch contents, left the key inserted in the device. Under this circumstance the key, being non-flush, was subject to being stepped upon and broken off in the lock, causing not only a tripping hazard, but also denying any access to the contents of the hatch compartment until the entire device could be laboriously removed from the hatch lid, usually causing destruction of the lifting device and severe damage to the lid.

Another prior art device used to lift and/or lock hatch lids purported to resolve the problem of the non-flush lifting device, but introduced other serious problems in that the closing mechanism frequently, through vibration and usage, lost its adjustment, making reliable usage impossible to maintain.

Both of the above described prior art devices as well as nearly all other known devices for lifting, opening and locking drawers, doors, hatch lids and the like, readily permit leakage of water into the enclosure. In the case of vertically mounted drawers, doors or closures, this may not be a serious disadvantage, but in the case of horizontally mounted hatch lids, hatch covers, and the like, water from spray, rainfall or hosing will, by gravity, enter the enclosure with resultant damage to the contents. Further, during weather below freezing temperature, the water leakage freezes, making it impossible to actuate the device and denying access to the contents of the compartment. In the case of a boat, the inability to retrieve life vests, flares and other equipment, or to service batteries and engines, constitute serious safety hazards.

Accordingly, it was also to overcome these disadvantages that the present highly effective, easily installed, easily maintained, and inexpensive lift ring was developed.

SUMMARY OF THE INVENTION

In accordance with this invention, we have provided a bail or lift loop of sturdy yet simplified construction that can be used in horizontal or vertical orientations, and that effectively and automatically returns to the flush position in its body or mounting plate when the bail or lift loop is not in use. The body may be provided with mounting holes in its peripheral or corner locations, such that it can be readily attached to a hatch lid by the use of screws or the like. The recessed central portion of the body is furnished with an aligned pair of holes in one end, in which holes the ends or pintles of the arm portions of the bail may be received.

When our lift ring is used on the hatch lid or hatch cover of a boat, we find it highly desirable to avoid a situation in which the lift loop or bail may tend to remain in the erect position so as to constitute a hazard to the boater. To that end, the pintles of our novel bail or lift loop that are to be received in the aligned holes in the mounting plate are so configured that the lift loop or bail tends to return immediately to the flush position being released, even though the device is mounted in a horizontal position. Advantageously, this automatic return of the bail to the flush position is achieved without the use of compression or tension springs, and without necessitating an expensive machining operation with respect to either the base member or lift loop. Also, our new lift ring can be mass produced at a minimum of expense.

Further, our lift ring is designed to eliminate all water leakage through the hatch lid, drawer or door irrespective of its horizontal or vertical positioning.

The Flowerday U.S. Pat. No. 4,189,804 entitled "Back Plate and Bail Assembly" taught an embodiment in which a generally U-shaped lift ring or bail contained outwardly projecting pintles or projections engaging the walls of a back member. The pintles were machine beveled with a generally wedge shaped configuration at the tip ends, the purpose of which was to facilitate the insertion or removal of the bail from the back member while preventing accidental removal. Flowerday clearly does not maintain that his device will return by gravity to its residence in the recess of the back member when the device is mounted in a horizontal position.

The Holtzhouser U.S. Pat. No. 807,170 of 1905 entitled "Flush Handle" taught an embodiment in which a generally U-shaped lift ring handle or bail contained outwardly projecting pivot ends or pintles engaging a body or plate. The Holtzhouser patent describes as the object of the invention, ". . . to provide . . . means for holding the handle proper so that when the latter is not in use it may hang down and lie flush . . . ". The words "hang down" imply that the handle would return to a flush position when the body or plate is mounted in a vertical position. However, there is nothing in the description of this patented device to provide a positive means of preventing the handle from reaching or exceeding a vertical position (i.e., dead center or past dead center) when the body or plate is mounted in a horizontal position.

It is this deficiency which our invention corrects, since our Self Closing Lift Ring is so configured as to return of its own volition, through gravity, even when the body plate is mounted horizontally.

In the embodiments of our invention in which the locking of a hatch is made possible, we provide a key lock that can be readily installed by drilling a single hole near the edge of a hatch lid. By approximately inserting such key lock, first through the base plate of the lift ring, then through the hatch lid, the complete lift ring assembly is secured to the hatch without the utilization of separate mounting screws being necessary. Furthermore, leakage of water into the compartment below is prevented, and the key can be removed from the body of the lock whether in the locked or unlocked position.

It is also to be noted that our novel lift ring device has a very low silhouette, assuring that the user will not trip over it.

Prior art lift ring devices commonly in use not only do not return to a flush position when mounted over carpeting on a deck or hatch lid, but are so configured in the hinging of their bail or pintle that interference between the fibers of the carpeting and the pintles often restricts the bail from returning to its flush position, regardless of the base position, vertical or horizontal.

Our invention, when mounted on carpeting, utilizes an inexpensive washer or spacer under the body, that separates the pintles from carpet fibers, thus assuring that the bail will function in all orientations to return to its flush position within the body when released.

It is therefore a primary object of our invention to provide a low cost yet highly effective lift ring that remains flush at all times except when it is in actual use.

It is another object of our invention to provide a lift ring that prevents water from leaking into a compartment or hatch below it, and effectively inhibits the retention of water in such quantity that the lift ring might become inoperative under freezing conditions.

It is still another object of our invention to provide a novel lift ring utilizing a bail or lift loop usable in a recessed base plate, with specially configured pintles on the ends of the bail compelling a return of the bail to the flush position at such time as the ball is released.

It is yet another object of our invention to provide a lift ring requiring the use of no comparison or tension springs, nor any expensive machining operations, yet dependably functioning to assure an automatic return of its bail to the flush position.

It is yet another object of our invention to provide a lift ring whose bail cannot be lifted to a completely vertical position from a horizontal mounting location, thus to prevent the bail from assuming, and then remaining in, a vertical position, where it might be a trip hazard.

It is yet still another object of our invention to provide a lift ring that may be attached to a hatch in various ways, including by the use of a centrally disposed keylock.

DETAILED DESCRIPTION

Figure 1:
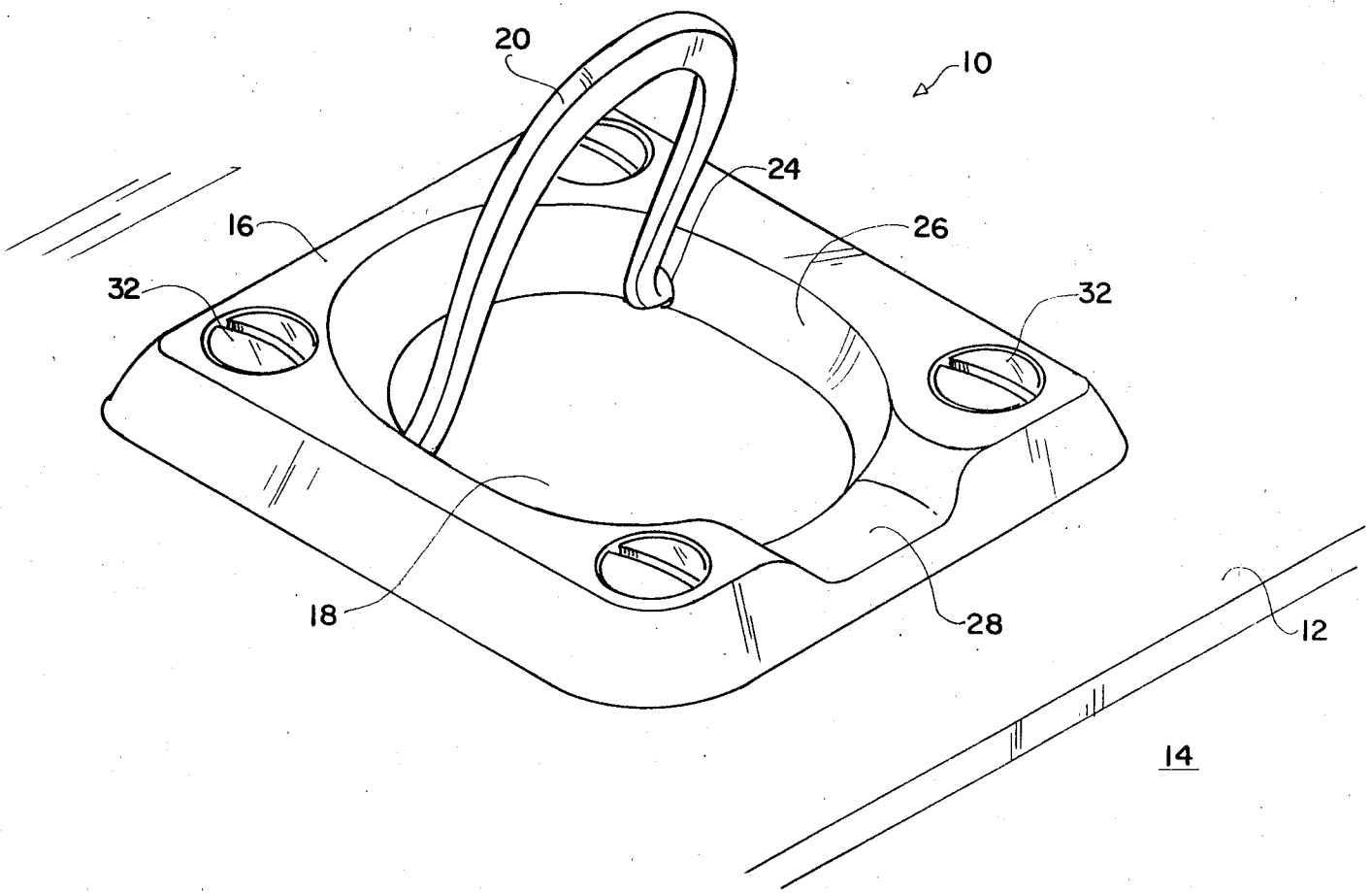
FIG. 1 is a perspective view of our novel lift ring device installed near the front edge of a hatch lid, with the bail or lift loop being in the raised position in this instance.

Turning to FIG. 1, it will be seen that we have shown an embodiment of our lift ring device 10 installed on a hatch lid 12, such as in the deck 14 of a boat or the like. Obviously we are not to be limited to the utilization of our lift ring on a hatch, or in connection with a boat.

Our lift ring principally comprises a base member 16, which has a central recess 18. The central recess is of a size to receive the bail or lift loop 20, when the bail has moved out of the illustrated upright position, and into a non-lifting position. In this latter position, the bail or lift loop resides in the plane of the base member 16, and within the angled sidewalls 26 that serve to define the periphery of the central recess 18.

As will be discussed hereinafter in connection with FIG. 4, the bail 20 is equipped at each of its lower ends with a pintle (or tang) 22, with each pintle being received in a respective hole of a pair of aligned holes 24 located in the angled sidewalls of the central recess 18. The sidewalls at the end of the recess remote from the holes 24 shorten in height to define a depression 28 simplifying the user grasping the center portion of the bail 20 when the bail is in its flush position, and also facilitating the draining of any water that otherwise might tend to accumulate in the central recess 18.

It is to be noted in the embodiment of FIG. 1, that we utilize a plurality of screw members 32 disposed at corner locations of the base plate or base member 16. It is to be realized, however, that any number of fastener types other than screws would be acceptable for securing base member 16 to hatch 12.

Figure 2:
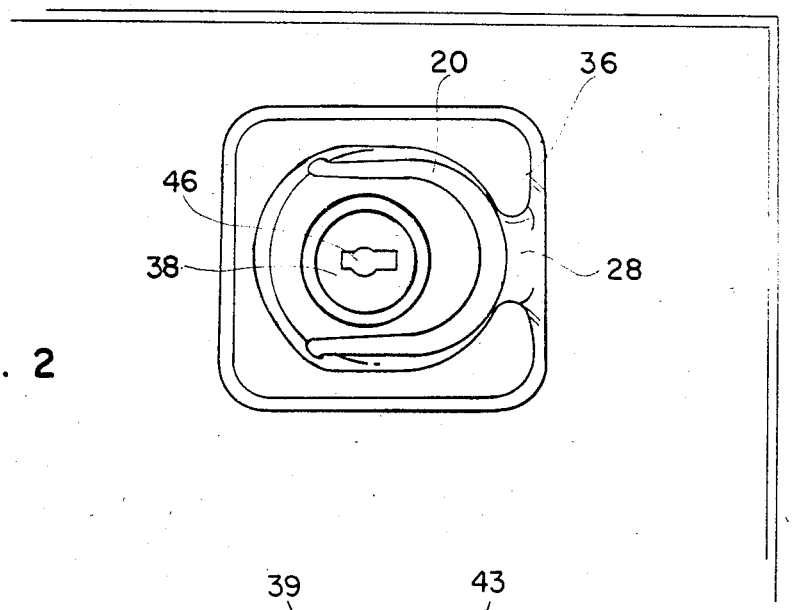
FIG. 2 is a view from above of a lift ring in accordance with this invention, wherein a key lock is utilized in the center of the device.

Turning to FIG. 2, it will be seen that we have shown to a smaller scale, a base member 36, which is very similar to base member 16, but differing in having a key lock 38 disposed in its central portion. This key lock not only makes it possible to lock the hatch in which the base member 36 may be mounted, but also the body of the lock 38 may be utilized for securing the base member to the hatch, thus obviating the use of the screws 32 previously mentioned. However, on the other hand, we may on occasion desire to use screws in peripheral locations, preferably in corner locations of the base member, in addition to the lock device securing the base member 36 to the hatch lid.

Figure 3:
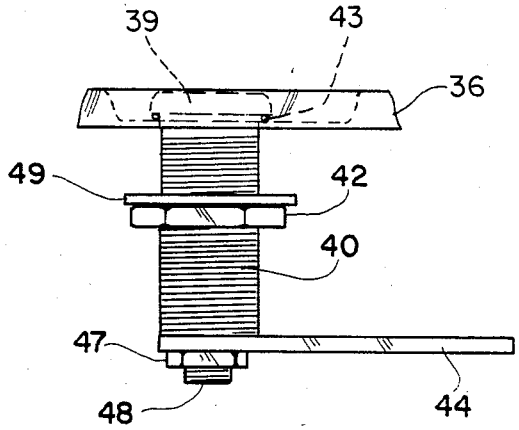
FIG. 3 is a side elevational view of the embodiment shown in FIG. 2, with this latter figure illustrating certain details of construction, and the cam member that is rotated when the hatch lid is to be locked.

As seen in FIG. 3, the key lock 38 has a threaded body portion 40, upon which body portion a nut 42 and internal tooth lockwasher 49 are received. Opposite side portions of the threaded body 40 are flattened, and the hole in the base member 36 is essentially circular, but with flattened portions matching the flattened side portions of threaded body 40. The flattened portions of members 36 and 40, when assembled in matching relation, prevent any rotation or twisting between lock 40 and body 36. When the body member of this assembly is thereafter inserted through an appropriate circular hole in hatch lid 12 and secured tightly by the use of the lockwasher 49 and nut 42, the assembly is prevented from rotation relative to its desired position on the hatch lid. As is obvious, lockwasher 49 serves to inhibit any loosening of the nut.

It is quite important to prevent leakage of water in all instances, such as in the embodiment shown in FIG. 2, where a hole has been cut or formed in the approximate center of the central depressed area of the member 36. To this end, it is desirable for us to utilize a suitable gasket or sealing ring between the head 39 of the lock body 38, and the base member 36. We prefer to place a suitable O-ring 43 around the threaded body 40, just below the head 39, and thereafter the lock body is inserted into the hole in the base member 36. Then, upon the lock body being inserted through the hole in the hatch lid, the lock washer 49 and nut 42 are installed on the threaded portion of the lock body, and the nut tightened. The O-ring then forms a leak proof seal between the base member 36 and the underside of the lock nut head 39.

Attached adjacent the bottom of the threaded body portion 40 is a cam member 44, held on rotatable threaded spindle 48 by a nut 47. The spindle and cam member are rotated with respect to the threaded body portion to a desired extent, upon the proper key being inserted into the key hole 46. When the cam 44 is in a position extending under or into the adjacent structure of the boat or other craft or structure, the hatch lid may be regarded as locked, whereas when the cam has been swung to a position say 90 degrees from that position, the cam does not engage the adjacent structure and the hatch lid is regarded as unlocked.

Where adjustment is desired in the distance between the body 36 and the portion of the adjacent structure to be engaged by the cam 44, the cam can be bent, or an alternative cam can be substituted, so that an appropriate offset will be achieved.

Also in FIG. 3, a common washer 41 is depicted. This washer is optional, and is utilized when our novel lift ring is to be installed over carpeting. Washer 41 has an outside diameter slightly less than the minimum inside width dimension of body 16, and an inside diameter slightly larger than the outside diameter of the lock body 40. This washer serves to separate and relieve any interference of the pintles from carpet fibers, thus assuring the automatic return of the bail to its recessed position in the body when released. It is to be noted that washer 41 typically is not used when mounting our lift ring on hard or semi-hard surfaces.

Figure 4:
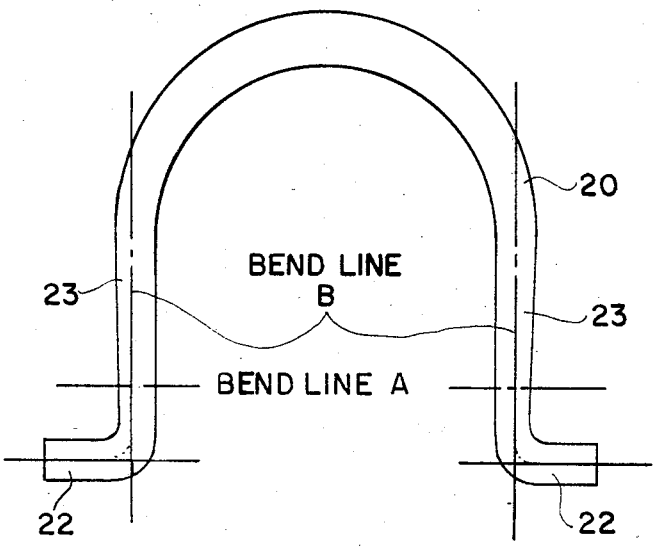
FIG. 4 is a view to a substantially larger scale of a bail or lift loop in accordance with this invention, showing the bend lines associated therewith.

Turning to FIG. 4, it will be seen that we have shown to a substantially larger scale, a bail or lift loop 20 in accordance with this invention. In this figure it is to be seen that the upper or central portion of the bail possesses substantial curvature, but with pintles 22 in this view being shown at essentially right angles to the arms 23 upon which they are mounted. However, as will be seen hereinafter, this is not the finished configuration for the pintles.

We bring about a controlled bending of the pintles, and to facilitate a discussion of the manner in which the pintles are bent, it will be noted in FIG. 4 that we have established a Bend Line A, that may, for example, be located above the centerline of pintles 22 by a distance equal to approximately twice the cross-sectional diameter of pintles 22. In addition, we have established longitudinal centerlines for the arms 23, and we regard Bend Line B as taking place about these arm centerlines.

For reasons later to be set forth, the bends about Bend Line A and Bend Line B in the illustrated configuration may each be in the vicinity of 15°, and as depicted in FIG. 4, these bend lines are preferably 90° away from each other.

Figure 5:
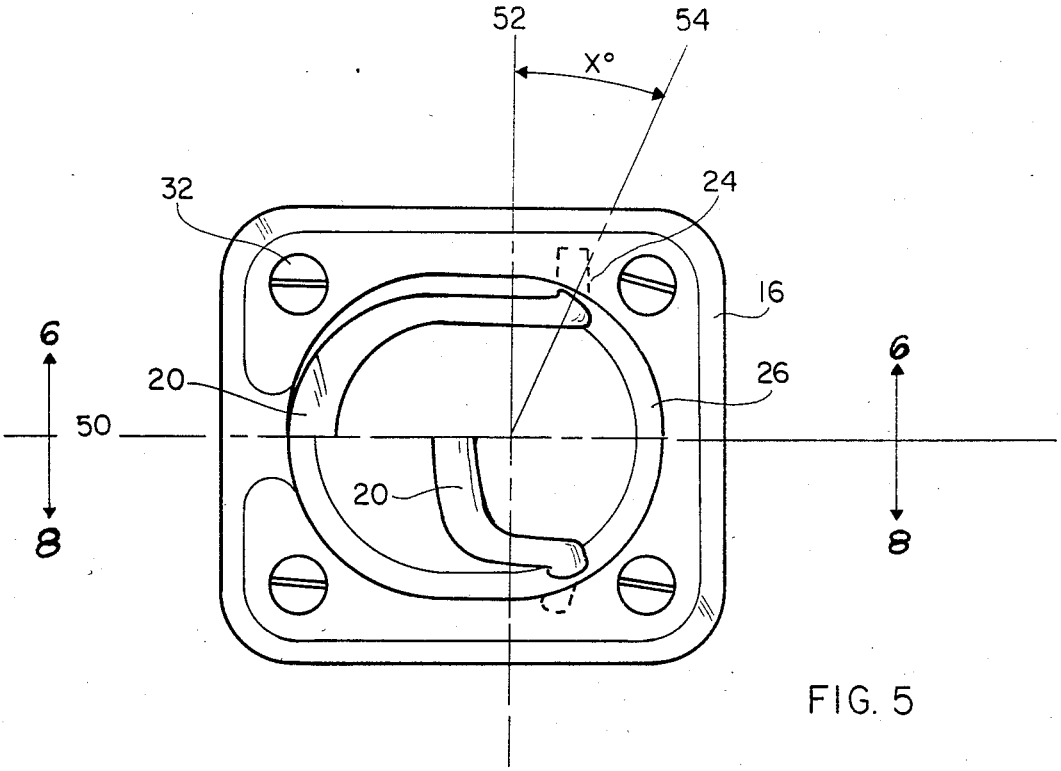
FIG. 5 is a view from above of an embodiment in which no central lock is provided, with this view being concerned with showing the bail or lift loop in two separate positions with respect to a central cutting plane.

Turning to FIG. 5, it will be seen that we have shown a base member 16 that has been bisected by a cutting plane 50, which passes equidistant between the holes 24 in the angled sidewalls, in which holes, the pintles are located. This cutting plane serves to divide the bail 20 into two halves. On the upper side of the longitudinal cutting plane 50, as viewed in FIG. 5, the bail 20 is shown in its flat or recessed position, in which it resides essentially completely in the recess 18, and in contact with a portion of the sidewalls 26.

Similarly, on the lower side of the cutting plane 50, as viewed in FIG. 5, it is to be noted that the bail is shown in a raised position, this being the position of the bail when, for example, a hatch lid is being raised.

Also visible in FIG. 5 is a reference line or cutting plane 52, that forms a right angle with the longitudinal cutting plane 50. It is at the intersection of these two planes where radii associated with the contour of sidewalls 26 are centered, and these radii define both the upper and lower boundaries of angled sidewall 26 in the area where holes 24 are located.

We find it advantageous for the holes 24 to be located on the arc portions of the angled sidewalls, and preferably in a plane 54 that bears an angle X° to the plane 52. The holes are disposed at this location in order to provide resistance to the pintle and bail when the bail is moved upward, and to cause the bail to stop short of a position 90° with respect to the body base plane. We prefer for the angle X° to exceed 20°/ It is to be realized that although one plane 54 is shown in FIG. 5, there is a plane 54 associated with both of the holes 24, and the same angle X applies thereto.

Although the two holes 24 in the base member 16 are initially circular, as a result of the drawing action by which the base member is configured, the holes become elongate in the direction perpendicular to the plane of base member 16.

Figure 7:
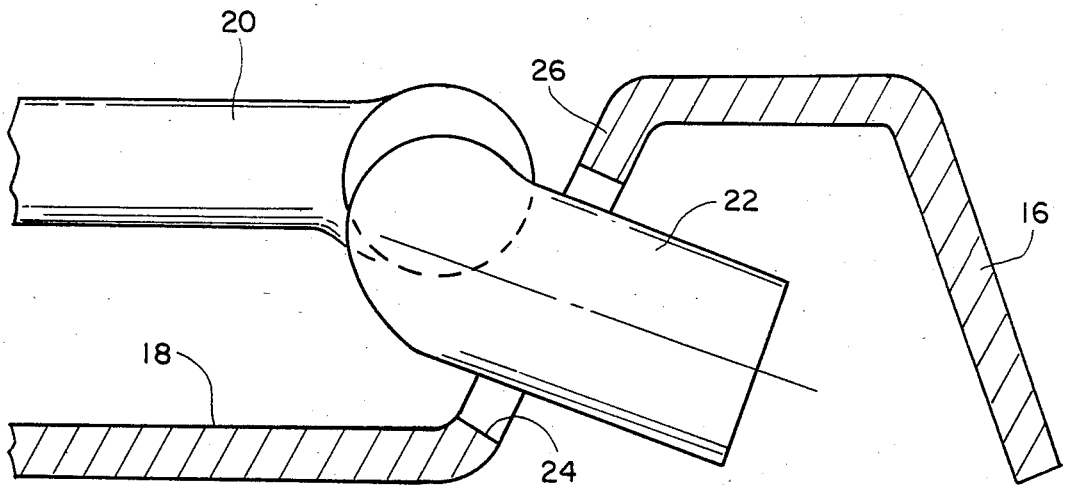
FIG. 7 is a cross sectional view to a still larger scale, revealing the interrelationship of a pintle with its mounting hole, this view being taken along lines 7—7 in FIG. 6, with the bail at rest in the plane of the base member.
Figure 6:
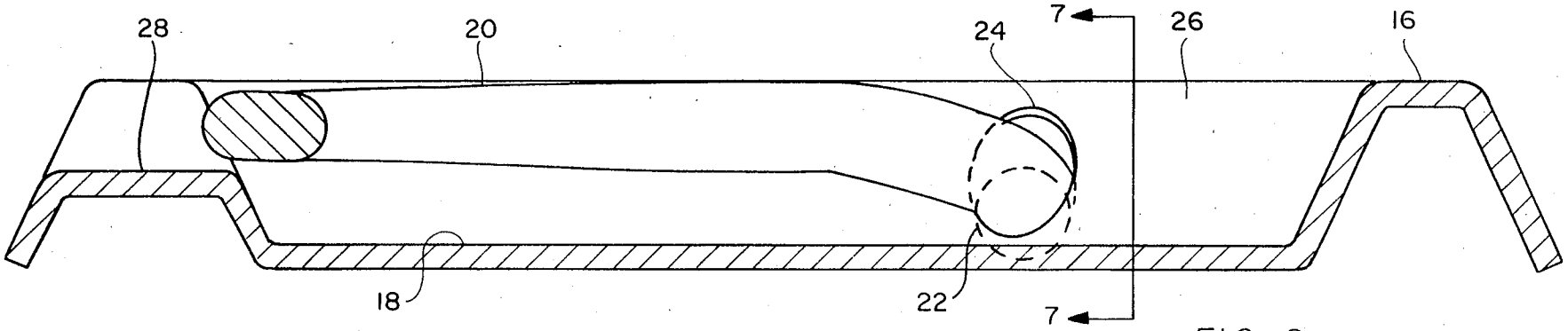
FIG. 6 is a cross sectional view to a substantially larger scale, of the embodiment of FIG. 5 at the location of the cutting plane 6—6.
Figure 8:
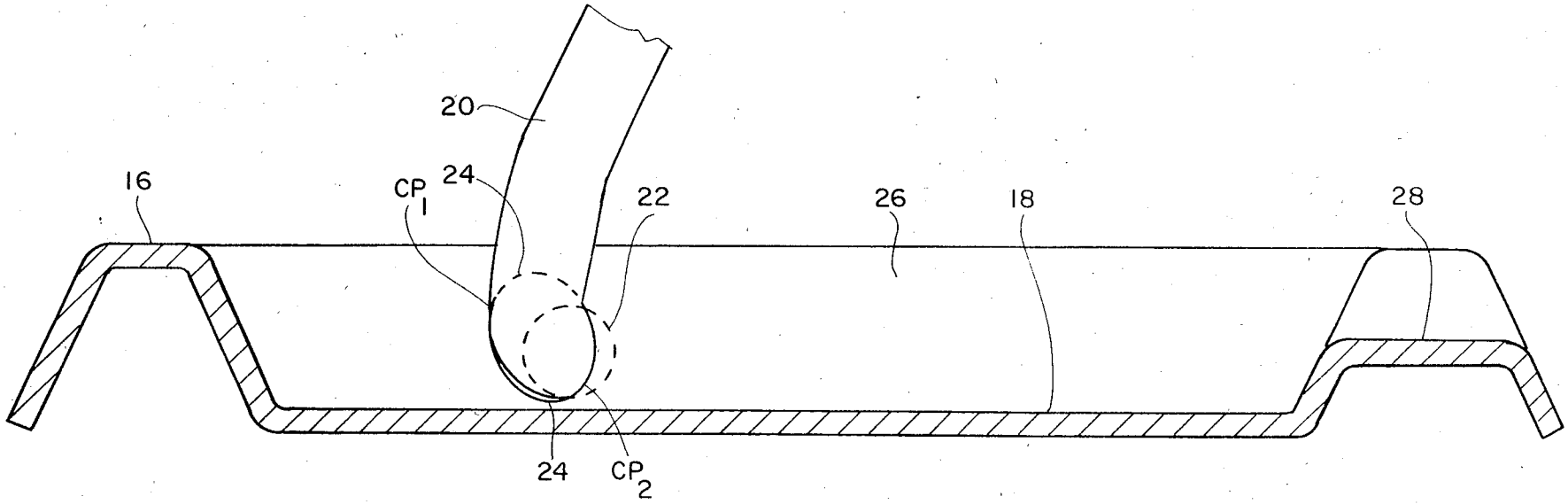
FIG. 8 is a cross sectional view of the base member at approximately the same scale as FIG. 6, but looking in the direction indicated by arrows 8—8 in FIG. 5, with the fragmentary showing of the bail in this view depicting the bail in its maximum raised position.

FIG. 5 and subsequent FIGS. 6, 7 and 8 are illustrations to explain and clarify the factors and relationships which, in combination, produce the effect of limiting the travel of the bail to a position less than the perpendicular with respect to the plane of body 16. These principal factors are:

The diameter and elongated configuration of holes 24,
The location of holes 24 in angled sidewall 26,
The location of holes 24 in the portion of the angled sidewall created by the aforementioned radii, and
The diameter and angularity of pintles 22 about Bend Lines A and B.

In FIGS. 6 through 8, the pintles 22 are to be regarded as being disposed in their respective holes 24, and in FIGS. 6 and 7, the bail is in its lowered position, corresponding of course to the position shown in the upper part of FIG. 5. It is to be noted that in FIGS. 6 and 7, a clearance exists between bail pintle and its respective hole 24, thus illustrating that there is no initial resistance to upward movement of the bail.

FIG. 8 shows bail 20 in its maximum raised position, corresponding to the position shown in the lower part of FIG. 5. It is to be understood that the relationship of the bends in pintle 22 to the elongated hole 24 in the sidewall 26 restricts pintle movement to an angularity of less than 90° from the plane of base 16, because of interference between the pintle 22 and sidewall of hole 24 at contact points CP1 and CP2.

An important feature of our invention may therefore be seen by comparing FIG. 6 and FIG. 8. As shown now be clear, when the bail and pintle are at rest, there is considerable clearance around the periphery of pintle 22 with respect to its hole 24, whereas in FIG. 8, due to the four principal factors related above, there is substantial interference or binding, effectively preventing bail 20 raising to a position that is 90° with respect to the plane of body 16.

Although we are not to be limited to particular dimensions in the construction of our novel Self Closing Lift Rings, in one preferred embodiment, the base member measured 2⅛" along the centerline residing in plane 50, and 1⅞" in width, and a ⅝" radius was used in the creation of the arcuate sidewalls.

The material of which the base member 16 or 36 is stamped may be brass, which later typically receives a nickel-chromium plating. The thickness of the member 16 or 36 may be approximately 1/32", and the pintles may have a diameter of approximately ⅛". Also, the bail or lift loop in one particular embodiment had a dimension of approximately 1 9/16" between the extreme outer ends of the pintles, and the dimension of approximately 1¼" from a line connecting the pintles, to the outer crest of the bail. The bail is preferably of stainless steel of a ⅛" wire diameter, with the central part of the bail being flattened in the plane of the bail, to a width of say 5/32".

After the forming or stamping process, the base member takes on a thickness of approximately ¼", which is a sufficiently small dimension as to avoid the likelihood of tripping. Also, and as previously mentioned, the bail or lift loop tends to remain in its recess, and not to protrude thereabove.

As to the forming of our novel bail, by the use of a first die, the bail is caused to assume the configuration shown in FIG. 4. Thereafter, it is bent about Bend Lines A and B.

The further bending of the initially formed bail about the bend axes is preferably brought about at room temperature by the use of a forming die, configured to accomplish the bending about Bend Line A and Bend Lines B at substantially the same time.

As will be apparent, the bending about Bend Lines B make it easier for the pintles to be inserted into their respective mounting holes 24 during assembly. The mounting holes typically are circular until the drawing process in which the central recess is created, at which time they become oval, with the long dimension perpendicular to the principal plane of the base member 16.

It should be obvious that in order to prevent the pintles from tending to pull out of their respective mounting holes, the normal configuration of the bail is one in which the pintles have a greater dimension between their outer portions, than is the distance between the holes 24. Because of this, it is necessary for the arms of the bail to be pinched together somewhat before the ends of the pintles can be inserted into the holes 24. Because the bail is made of appropriate and springy material, there is little if any tendency for the bail to sever its connection to the base member 16.

It should now be apparent that in accordance with this invention, we accomplish the goal of providing a Self Closing Lift Ring by the inexpensive procedure of configuring the base member to have a pair of bail mounting holes in the arcuate portions of its angled sidewalls, and causing the bail used with the base member to have pintles bent about specifically designated bend axes located in orthogonal relation to each other. As a result of this novel construction, the bail or lift ring automatically returns to a recessed position, thus solving the problem of how to eliminate the customary trip hazard posed by the use of prior art lift rings about a boat, or other vehicle or structure. Advantageously, we accomplish the foregoing without the use of springs, or any other device prone to fail, corrode, or wear out.

Although we normally create both holes 24 to be non-circular, and bend both of the pintles 22 out of the plane of the lift loop, our device would still be operative in the intended manner if only one hole is non-circular, and only the one pintle associated therewith is bent out of the plane of the lift loop.

We claim:

1. A locking lift ring comprising a base member having a central recess bounded by sidewalls symmetrically placed with respect to the centerline of said base member, a bail pivotally mounted in said base member, and configured to reside entirely within the confines of said central recess when not in use, said base member having a pair of holes located in the sidewalls of said recess, said holes being symmetrically placed with respect to the centerline of said base member, said bail having outwardly extending pintles residing in said pair of holes, so as to form the pivotal support for said bail, at least one of said holes being slightly non-circular and at least the corresponding outwardly turned pintle being bent out of the plane of said bail, latter pintle having an axis bent out of the plane of the bail, and being rotatable in said non-circular hole for only a limited number of degrees of bail movement, with the relationship of latter pintle and hole effectively preventing said bail from being raised away from said base plate to an orthogonal position, and a tumbler lock disposed in substantially the center of said recess, said lock having a keyhole at one end, and having a cam mounted at its other end, such that the cam can be rotated to engage an adjacent structure when the correct key has been inserted into the keyhole.

2. A locking lift ring as defined in claim 1 in which said bail is configured and arranged to return to its position in said recess immediately upon being released.

3. The locking lift ring as defined in claim 1 in which said lock forms the means for holding the base member on a mounting surface.

4. A lift ring device arranged to normally remain in a flush condition, said device having a generally U-shaped lift loop, and a base plate in which said lift loop is pivotally mounted, said lift loop having a pair of arm portions of substantially equal length, with each arm portion terminating in an outwardly extending pintle having an axis bent out of the plane of said lift loop, a base plate having a central recess approximately the size of said lift loop, said recess being defined over a substantial portion of its circumference by angled sidewalls, a pair of holes located in said angled sidewalls and being elongate in a direction essentially perpendicular to the plane of said central recess, said holes being symmetrically located with respect to said central recess and receiving said pintles of said lift loop, said pintles, because of being bent out of the plane of said lift loop, interacting with their respective holes as to prohibit said lift loop from residing in a perpendicular direction with respect to said base plate.

5. The lift ring device as defined in claim 4 in which said pintles are bent out of the plane of the lift loop about two separate axes spaced 90° apart.

6. The lift ring device as defined in claim 4 in which the end of said central recess remote from said aligned holes has a sidewall of reduced height to facilitate a user grasping the central portion of said lift loop, and to drain off any water tending to accumulate in said central recess.

7. The lift ring device as defined in claim 4 in which a central hole of non-circular configuration is formed in said central recess, in which central hole a key lock may be disposed, with said key lock serving as the means for securing said base plate to a movable member.

8. The lift ring device as defined in claim 4 in which said base plate is provided with a plurality of mounting holes disposed in spaced relationship about its periphery, said mounting holes being of a configuration to receive mounting fasteners.

9. The lift ring device as recited in claim 4 in which said pair of holes is located on arc portions of said angled sidewalls.

10. A lift ring device tending to remain flush with its mounting surface except when in actual use, comprising a generally U-shaped bail, and a base plate in which said bail is pivotally mounted, said bail having a pair of arm portions of substantially equal length, with each arm portion terminating in an outwardly turned pintle, about which pintles said bail is rotatable, said base plate having an elongate central recess approximately the size of said bail, and also having aligned holes to receive said outwardly turned pintles, at least one of said holes being slightly non-circular and located in the sidewall formed around said recess, at least the corresponding outwardly turned pintle having an axis bent out of the plane of said bail, and being rotatable in said non-circular hole for only a limited number of degrees of bail movement, with the relationship of latter pintle and hole effectively preventing said bail from being raised away from said base plate to the orthogonal position.

11. The lift ring device as recited in claim 10 in which both of said holes are slightly non-circular, and both of said pintles are bent out of the plane of said bail.

12. The lift ring device as recited in claim 10 in which a plurality of mounting holes is disposed in spaced relation about the periphery of said base plate, said mounting holes being adapted to receive fasteners used to secure the mounting plate to a hatch lid.

13. The lift ring device as recited in claim 10 in which a non-circular hole is disposed approximately in the center of said recess, said non-circular hole being adapted to receive the barrel of a key lock, said key lock serving to secure said base plate to a hatch lid.

14. The lift ring device as recited in claim 10 in which said pintles are bent out of the plane of the bail about two separate axes, spaced 90° apart.

15. The lift ring device as recited in claim 10 in which said aligned holes are located on arc portions of said sidewall.

16. A lift ring device tending to normally remain in a flush condition with its mounting surface except when in actual use, said device having a lifting member, and a base plate in which said lifting member is pivotally mounted, said lifting member having a pair of outwardly extending pintles, said base plate having angled sidewalls defining a central recess approximately the size of said lifting member and also having aligned holes to receive said outwardly turned pintles, at least one of said holes being slightly non-circular, the outwardly turned pintle operatively associated with said one hole being bent out of the plane of said lifting member so as to coact with its hole in a motion-inhibiting manner, thus to prevent said lifting member from reaching a position orthogonal to said base plate.

17. A lift ring device arranged to normally remain in a flush condition with its mounting surface except when in actual use, said device having a lifting loop, and a base plate in which said lifting loop is pivotally mounted, said lifting loop residing in a plane essentially parallel to the plane of said base plate when said lifting loop is not in use, said lifting loop having a pair of outwardly extending pintles, said base plate having a central recess in which said lifting loop is normally contained, said recess being defined over a substantial portion of its circumference by angled sidewalls, a pair of holes in said sidewalls, elongate in a direction essentially perpendicular to the plane of said base plate and disposed substantially equidistant from the plane of said base plate, in which holes said pintles of said lifting loop are rotatably mounted, at least one of said pintles having an axis bent out of the plane of said lifting loop, and being rotatable in its corresponding elongate hole for only a limited number of degrees by virtue of the nonplanar position of said pintle with said lifting loop, with the interaction of said one pintle with the wall of its respective hole being such as to prohibit said lifting loop from reaching a perpendicular relationship with respect to said base plate.

18. A lift ring device tending to remain flush with its mounting surface except when in actual use, comprising a lift loop, and a base plate in which said lift loop is pivotally mounted, said lift loop having a longitudinal centerline and a pair of arm portions of substantially equal length, with each arm portion being symmetrically disposed with respect to said longitudinal centerline, and each arm portion terminating in an outwardly turned pivot portion, said base plate having a central recess approximately the size of said lift loop and having sidewalls in which are disposed aligned holes to receive said outwardly turned pivot portions, at least one of said holes being slightly elongate, at least the outwardly turned pivot portion corresponding to said one hole having an axis bent out of the plane of said lift loop so as to coact with that hole in a motion-inhibiting manner, the sidewall in which said elongate hole resides being situated in a longitudinal direction that is not parallel to said longitudinal centerline of said lift loop, said lift loop not being movable to an orthogonal position with respect to said base plate because of the motion-inhibiting relationship of said one pivot portion with its respective hole.

19. The lift ring device as recited in claim 18 in which said sidewall containing said aligned holes is generally arcuately shaped.

20. A lift ring device tending to remain flush with its mounting surface except when in actual use, comprising a generally U-shaped lift loop, and a base plate in which said lift loop is pivotally mounted, said lift loop having a longitudinal centerline and a pair of arm portions of substantially equal length, with each arm portion being symmetrically disposed with respect to said longitudinal centerline, and each arm portion terminating in an outwardly turned pivot portion, said base plate having a central recess approximately the size of said lift loop, and having sidewalls around said recess in which are located aligned holes to receive said outwardly turned pivot portions, at least one of said holes being elongate in a direction approximately perpendicular to the base plane, said sidewalls being non-perpendicular to the plane of said recess, at least the outwardly turned pivot portion corresponding to said one hole axis bent out of the plane of said lift loop so as to coact with its respective hole in said sidewall in a motion-inhibiting manner, the sidewall in which said elongate hole resides being situated in a non-parallel longitudinal direction with respect to said longitudinal centerline of said lift loop, whereby said pivot portion bent out of the plane of said lift loop coacts with its hole in such a way as to prevent said lift loop from reaching a position perpendicular to the plane of said base.

21. The lift ring device as recited in claim 20 in which said holes are located in arcuately configured portions of said sidewalls.

* * * * *